US008720451B2

(12) United States Patent
Bartram

(10) Patent No.: US 8,720,451 B2
(45) Date of Patent: May 13, 2014

(54) WRAPPER FOR A SMOKING ARTICLE

(75) Inventor: Sabrina Bartram, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/702,563

(22) PCT Filed: May 24, 2011

(86) PCT No.: PCT/EP2011/058429
§ 371 (c)(1),
(2), (4) Date: Feb. 12, 2013

(87) PCT Pub. No.: WO2011/154246
PCT Pub. Date: Dec. 15, 2011

(65) Prior Publication Data

US 2013/0142993 A1 Jun. 6, 2013

(30) Foreign Application Priority Data

Jun. 7, 2010 (GB) ..... 1009525.5

(51) Int. Cl.
*A24D 1/02* (2006.01)
*A24C 5/56* (2006.01)

(52) U.S. Cl.
USPC ..... 131/365; 131/346; 428/139

(58) Field of Classification Search
USPC ..... 162/114, 140; 283/105; 428/139; 229/92.3
See application file for complete search history.

(56) References Cited

U.S. PATENT DOCUMENTS

| | | | | |
|---|---|---|---|---|
| 2,958,328 | A | 11/1960 | Bartolomeo | |
| 3,291,136 | A | 12/1966 | Boyer | |
| 3,370,592 | A | 2/1968 | Schultz et al. | |
| 4,256,124 | A * | 3/1981 | Higgins et al. | 131/29 |
| 4,289,565 | A * | 9/1981 | Wilkins | 156/514 |
| 4,588,463 | A * | 5/1986 | Barber et al. | 156/200 |
| 2002/0153017 | A1 * | 10/2002 | Georgitsis et al. | 131/331 |

FOREIGN PATENT DOCUMENTS

| | | | |
|---|---|---|---|
| CH | 394912 | A | 6/1965 |
| GB | 0876796 | A | 9/1961 |
| GB | 1446472 | A | 8/1976 |
| WO | WO2004/068975 | A1 | 8/2004 |
| WO | WO 2011/038430 | A1 | 4/2011 |

OTHER PUBLICATIONS

International Search Report and Written Opinion, mailed Aug. 31, 2011, for PCT International Application No. PCT/EP2011/058429, filed May 24, 2011.
International Preliminary Report on Patentability, mailed Sep. 28, 2012, for PCT International Application No. PCT/EP2011/058429, filed May 24, 2011.
United Kingdom Intellectual Property Office Search Report, dated Sep. 21, 2010, for GB1009525.5.
Written Opinion, mailed Jul. 9, 2012, for PCT International Application No. PCT/EP2011/058429, filed May 24, 2011.
First Office Action, issued Oct. 21, 2013 for corresponding Chinese Patent Application No. 201080028309.6, filed May 24, 2011. [With English Translation].

* cited by examiner

*Primary Examiner* — Richard Crispino
*Assistant Examiner* — Eric Yaary
(74) *Attorney, Agent, or Firm* — N W Poulsen

(57) ABSTRACT

A wrapper (16) for a smoking article filter, the wrapper comprising at least one aperture (20) and an additional strengthening material (22) around the at least one aperture. A filter for a smoking article comprising such a wrapper, and a method of manufacturing such a wrapper and such a filter.

17 Claims, 8 Drawing Sheets

WRAPPER FOR A SMOKING ARTICLE

CLAIM FOR PRIORITY

This application is a National Stage Entry entitled to and hereby claims priority under 35 U.S.C. §§365 and 371 to corresponding PCT Application No. PCT/EP2011/058429, filed May 24, 2011, which in turn claims priority to GB Application No. 1009525.5, filed Jun. 7, 2010. The entire contents of the aforementioned applications are herein expressly incorporated by reference.

The present invention relates to a wrapper for a smoking article and, more particularly, to a filter wrapper having a window portion formed therein, a filter including such a wrapper and a method of manufacturing the same.

Conventional smoking articles can comprise a cylinder of smoking material contained within a paper sleeve, known as a 'tobacco rod', with a filter at one end thereof. The filter generally comprises a plug of filtration material wrapped around its circumference by a plugwrap and, an outer paper tipping wrapper wrapped around the wrapped plug of filtration material. The outer tipping wrapper extends beyond the end of the wrapped plug of filtration material and overlies the join between the wrapped filter material and the tobacco rod, such that the tipping wrapper attaches the wrapped plug of filtration material to the tobacco rod to form a smoking article.

Alternative forms of filters for smoking articles are known, for example, as disclosed in WO 2004/068975, which describes a filter for a smoking article having a pair of filter segments spaced from each other and a tipping wrapper which surrounds the filter segments and secures the filter to a tobacco rod to form a smoking article. The tipping wrapper is formed from discrete sections of opaque paper either side of a discrete section of transparent material, which are bonded together to form the tipping wrapper. This prior art filter construction thereby provides a window from the transparent material so that a portion of the filter material is visible therethrough.

However, the above prior art filter suffers the disadvantage that the complex construction of the tipping wrapper formed from discrete sections of material bonded together means that manufacture is more complicated and thereby costly.

A further known smoking article is disclosed in US 2002/0153017 and comprises a tobacco rod having a filter attached to one end thereof. The filter comprises a plurality of plugs of filter material wrapped with a transparent plugwrap. The filter is attached to the tobacco rod with a tipping wrapper, which may include one or more windows formed therein to enable the filter material to be visible. However, this prior art suffers the disadvantage that the windows formed by apertures in the outer paper tipping wrapper creates a weakness in the tipping wrapper. This is especially problematic if the tipping wrapper includes a plurality of such apertures, for example, so that a number of windows are circumferentially positioned around the resulting filter. This can result in the tipping wrapper tearing during manufacture of a smoking article, especially if the tipping wrapper is conveyed through machinery as a continuous band after the apertures are formed therein, such as over rollers, prior to being wrapped around a smoking rod and cut. It will be appreciated that if the tipping wrapper band tears and breaks, the machinery must be stopped and the tipping wrapper band re-fed through the machine, resulting in loss of production time and inconvenience.

In addition to the above, the cutting or punching of apertures in the tipping wrapper can result in production of swarf from the punching process, and the edges of the aperture may not always be clean-cut due to the fibrous nature of the paper of the tipping wrapper.

The present invention seeks to provide an alternative construction of a wrapper for a filter for a smoking article which is substantially alleviates or overcomes the problems of the prior art filter wrappers mentioned above, a filter including such a wrapper and a method of producing the same.

Accordingly, the present invention provides a wrapper for a smoking article filter, the wrapper comprising at least one aperture and an additional strengthening material around the at least one aperture.

Preferably, the at least one aperture is to define at least one window in the smoking article filter so that, once the filter has been assembled, one or more components of the filter are visible through said window.

The strengthening material is preferably bonded to the wrapper by adhesive and the strengthening material may comprise metal foil.

The wrapper may comprise a plurality of apertures and the plurality of apertures may be formed through the or each portion of strengthening material on the wrapper.

The strengthening material may extend into the aperture around the edges of the aperture in the wrapper material.

The present invention also provides a filter for a smoking article comprising a cylindrical plug of filtration media, a plugwrap of at least partially transparent material wrapped around the plug of filtration media and, an outer wrapper as described above, circumscribing the plug and plugwrap, wherein the plug and plugwrap are visible through a window defined by the at least one aperture.

The filter may comprise a plurality of apertures and the plurality of apertures may be formed circumferentially around the filter.

The filter may comprise a plurality of axially aligned cylindrical plugs of filtration media, and at least two of the plugs may be axially spaced from each other to define an empty cavity between the plugs of filtration media. Alternatively, at least two of the plugs may be axially spaced from each other to define a region between the plugs of filtration media which is filled with an adsorbent material.

A portion of the filtration media may comprise indicia or graphics on an outer surface thereof so as to be visible through said at least one window, and/or the plugwrap may comprise indicia or graphics on an outer surface thereof so as to be visible through said at least one window.

The plugwrap may be formed of a translucent and/or tinted material.

The wrapper may comprise a tipping wrapper extending in an axial direction beyond the distal end of the plug(s) of filtration media remote from a mouth end portion to allow the filter to be attached to a rod of smoking material.

The present invention also provides a smoking article comprising a rod of smoking material having a filter as described above.

The present invention also provides a method of manufacturing a filter for a smoking article comprising circumscribing the filter with a wrapper having at least one aperture formed therein defining at least one window, the wrapper further comprising an additional strengthening material around the at least one aperture.

The method may further comprise wrapping a cylindrical plug of filtration media with an at least partially transparent plugwrap, and wherein the step of circumscribing the filter with the wrapper may comprise circumscribing the wrapped plug of filtration media with the wrapper so that the plug and plugwrap are visible through said window.

The method may further include the step of bonding the strengthening material to the wrapper when the wrapper is in the form of a continuous band of material, and subsequently cutting the wrapper to individual sections.

The present invention also provides a method of manufacturing a wrapper for a filter for a smoking article, the method comprising bonding a strengthening material to a band of wrapper material and forming a plurality of apertures though the strengthening material and through the wrapper material.

The step of bonding the strengthening material to the wrapper material may comprise using heat and/or pressure to activate an adhesive layer on the strengthening material.

The method may further comprise forming the at least one aperture in the wrapper material after the strengthening material is bonded to the wrapper material.

The method may further comprise forming the at least one aperture in the wrapper material by a cutter.

The method may further comprise forming the at least one aperture in the wrapper material by cutting with a laser.

The step of forming the at least one aperture in the wrapper material may comprise forming the at least one aperture through both the wrapper material and the strengthening material simultaneously.

The strengthening material may be applied to the continuous band of wrapper material by passing a laminate strip, comprising a carrier layer and a layer of the strengthening material, together with the band of wrapper material, between a pair of rollers which press the strengthening material onto the band of wrapper material.

At least one of the rollers may include a die on an outer surface thereof and the step of passing the laminate strip together with the band of wrapper material between a pair of rollers may comprise the at least one die pressing a portion of the layer of strengthening material into contact with the band of wrapper material.

The step of the at least one die pressing a portion of the laminate strip and the layer of strengthening material into contact with the band of wrapper material may comprise the portion of strengthening material detaching from the carrier layer and adhering to the band of wrapper material.

At least one of the rollers may be heated so that the at least one heated roller applies heat to the laminate strip and the band of wrapper material as they pass between the rollers to activate a layer of adhesive formed on the layer of strengthening material.

The method may further comprise the step of passing the band of wrapper material between a second set of rollers, at least one roller of the second set of rollers including a cutter formed on an outer surface thereof and, the at least one aperture in the wrapper material being formed by the cutter as the band of wrapper material passes through the second set of rollers.

Alternatively, the step of applying the strengthening material to the band of wrapper material by passing a laminate strip together with the band of wrapper material between a pair of rollers which presses the layer of strengthening material onto the band of wrapper material, may also comprise cutting the at least one aperture as the band of wrapper material passes through the first set of rollers.

The die on the outer surface of said at least one of the rollers may also include a cutter element, and the step of passing the laminate strip together with the band of wrapper material between a pair of rollers may comprise the at least one die pressing a portion of the layer of strengthening material into contact with the band of wrapper material so that a portion of strengthening material detaches from the laminate strip and adheres to the band of wrapper material and, the cutter element of the die cutting the at least one aperture as the band of wrapper material passes through the first set of rollers.

The cutter element may be spring-biased within the die and the cutter may be pushed out from within the die to cut the at least one aperture as the die presses against the other roller of the first pair of rollers.

The cutter may cut the at least one aperture through the strengthening material and the wrapper material, and the cutter may cut from the strengthening material side of the band of wrapper material.

The step of cutting the at least one aperture may comprise forming the strengthening material around the edges of the aperture in the wrapper material.

The strengthening material may comprise metal foil, and may comprise aluminium foil.

Preferred embodiments of the present invention will now be described, by way of example only, with reference to the accompanying drawings, in which.

Figure 1:
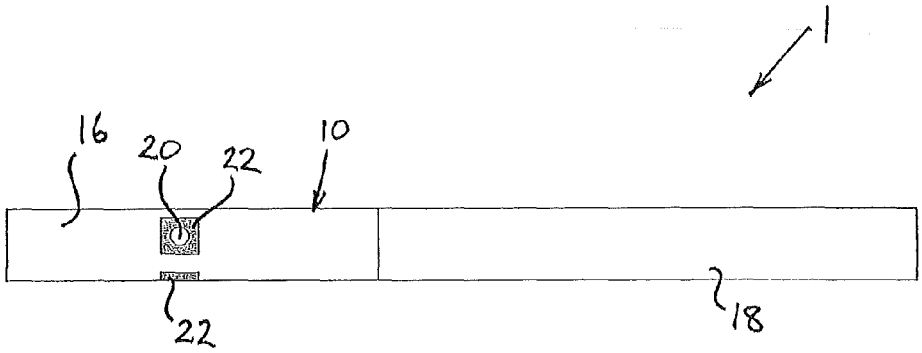
FIG. 1 is a perspective view of a smoking article including a filter according to the present invention.
Figure 2:
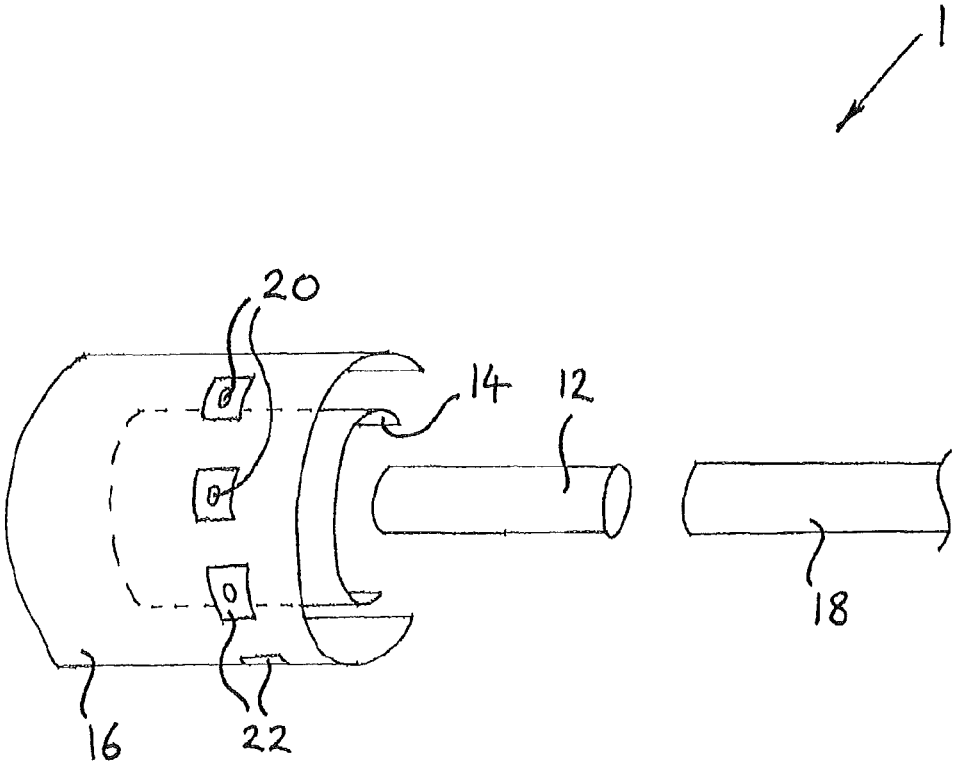
FIG. 2 is an exploded perspective view of the smoking article including filter shown in FIG. 1.

Referring now to FIGS. 1 and 2, a smoking article 1 comprising a filter 10 of a first embodiment of the present invention is shown, the filter 10 comprising a cylindrical plug 12 of filtration media surrounded by a plugwrap 14 which extends entirely around the outer circumference of the plug 12. The plugwrap 14 is made of a transparent material such that the filtration media is visible though the plug wrap.

A paper outer tipping wrapper 16 is circumscribed around the wrapped plug of filtration media 12 and extends beyond the distal end of the plug 12 remote from a mouth end of the filter 10 to extend over and adhere to a distal end of a tobacco rod 18, to secure the tobacco rod 18 to the filter 10 to form the smoking article 1.

The tipping wrapper 16 includes a plurality of apertures 20 therein arranged circumferentially around the filter 10. Each aperture is 20 surrounded by a portion of strengthening material 22 bonded to the tipping wrapper 16. The strengthening material 22 is preferably a thin layer of metal foil, although other material may be used within the scope of the invention, such a plastic material. The apertures 20 form windows in the filter 10 such that the underlying plugwrap 14 is visible though each aperture 20. Furthermore, as the plugwrap 14 is made from a transparent material, the plug of filtration media 12 is visible through each aperture 20 and through the plugwrap 14.

The transparent material of the plugwrap 14 can be, but is not limited to, one of polypropylene, polyvinyl chloride (PVC), cellulose acetate film, polyethylene terephthalate (PET), polyethylene oxide (PEOX), polyethylene, cellophane, Natureflex™ or polyactic acid (PLA).

Figure 3:
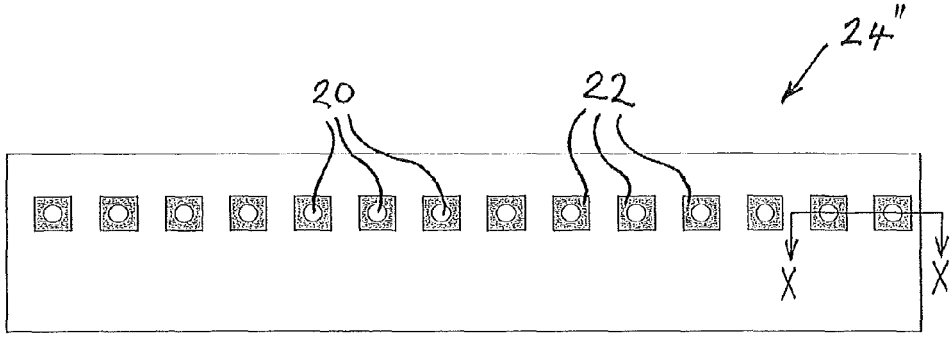
FIG. 3 is a plan view of a section of continuous band of wrapper material of the invention used in the manufacture of the filter and smoking article of FIGS. 1 and 2.

The tipping wrapper 16 of the filter 10 is formed as a continuous band and then cut into discrete sections during manufacture of the smoking article 1. A section of the continuous band of tipping wrapper 16 is shown in FIG. 3 where it can be seen that the band of tipping wrapper material includes a plurality of apertures 20 aligned along the length of the band, each with a surrounding section of the strengthening material 22.

A process for manufacturing the continuous band of tipping wrapper 16 will now be described with reference to the schematic drawings of the manufacturing apparatus shown in FIG. 4. A continuous band 24 of tipping wrapper material is fed, for example from a roll (not shown), between a first pair of rollers 26, 28. A continuous strip 30 of the strengthening material 22 is fed together with the band 24 of tipping wrapper material between the first pair of rollers 26, 28. One of the first rollers 26 is heated and also includes a die 32 on an outer circumferential surface thereof. The strip 30 of strengthening material 22 and the band 24 of tipping wrapper material are fed through the first pair of rollers 26, 28 such that the strip 30 of strengthening material 22 is proximate the heated roller 26 which includes the die 32. As the die 32 comes into contact with the strip 30 of strengthening material 22, is presses a portion of the strip 30 of strengthening material 22 into contact with the band 24 of tipping wrapper material and cuts out that portion of strengthening material 22 from the strip 30. Furthermore, as the roller 26 which includes the die 32 is heated, the hot die 32 activates a heat-activated adhesive (see FIG. 5) on a side of the cut-out section of strengthening material 22 adjacent to the band 24 of tipping wrapper, so that the cut out section of strengthening material 22 is then bonded to the continuous band 24 of tipping wrapper material.

As the first rollers 26, 28 rotate and the strip 30 of strengthening material 22 and band 24 of tipping wrapper material are fed between them, the above process is repeated so that a band 24' of tipping wrapper material with a series of discrete sections of strengthening material 22 adhered thereto is formed.

After the band 24' of tipping wrapper material with sections of strengthening material 22 is fed away from the first pair of rollers 26, 28, it then passes through a second pair of rollers 34, 36. One of the second rollers 34 includes a cutter 38 on an outer circumferential surface thereof and the band 24' of tipping wrapper with strengthening material 22 adhered thereto passes between the second pair of rollers 34, 36 such that the side with the strengthening material 22 thereon is adjacent the roller 34 with the cutter 38. Furthermore, the speed and position of the band 24' of tipping wrapper with strengthening material 22 adhered thereto is calibrated with respect to the speed of rotation and diameter of the second pair of rollers 34, 36 such that the position of each discrete section of strengthening material 22 is in register with when the cutter 38 on the respective second roller 34 presses against the other of the second rollers 36. Thereby, the cutter 38 cuts out an aperture 20 from the band 24' of tipping wrapper at the point where each discrete section of strengthening material 22 is positioned, forming the aperture 20 though both the tipping wrapper material and the strengthening material 22. As a result, each aperture 20 is reinforced around its periphery by the strengthening material 22, which prevents the resulting band 24" of tipping wrapper with reinforced apertures 20 therein from tearing in subsequent manufacturing steps of the smoking article 1. Furthermore, since the apertures 20 are cut though the sections of strengthening material 22, the edges of the apertures 20 are cut cleanly without any fraying of the tipping wrapper material or swarf from the cuts being produced. This leads to a cleaner process and a much neater final tipping wrapper 16, improving the premium appearance of the resulting smoking article 1.

The continuous band 24" of tipping wrapper with strengthened apertures 20 therein is then fed to an apparatus for the manufacture of smoking articles (not shown) and is adhered around wrapped plugs of filtration media overlying the join between the plugs and a tobacco rod in a known manner, to form smoking articles 1 as shown in FIGS. 1 and 2.

Figure 5:
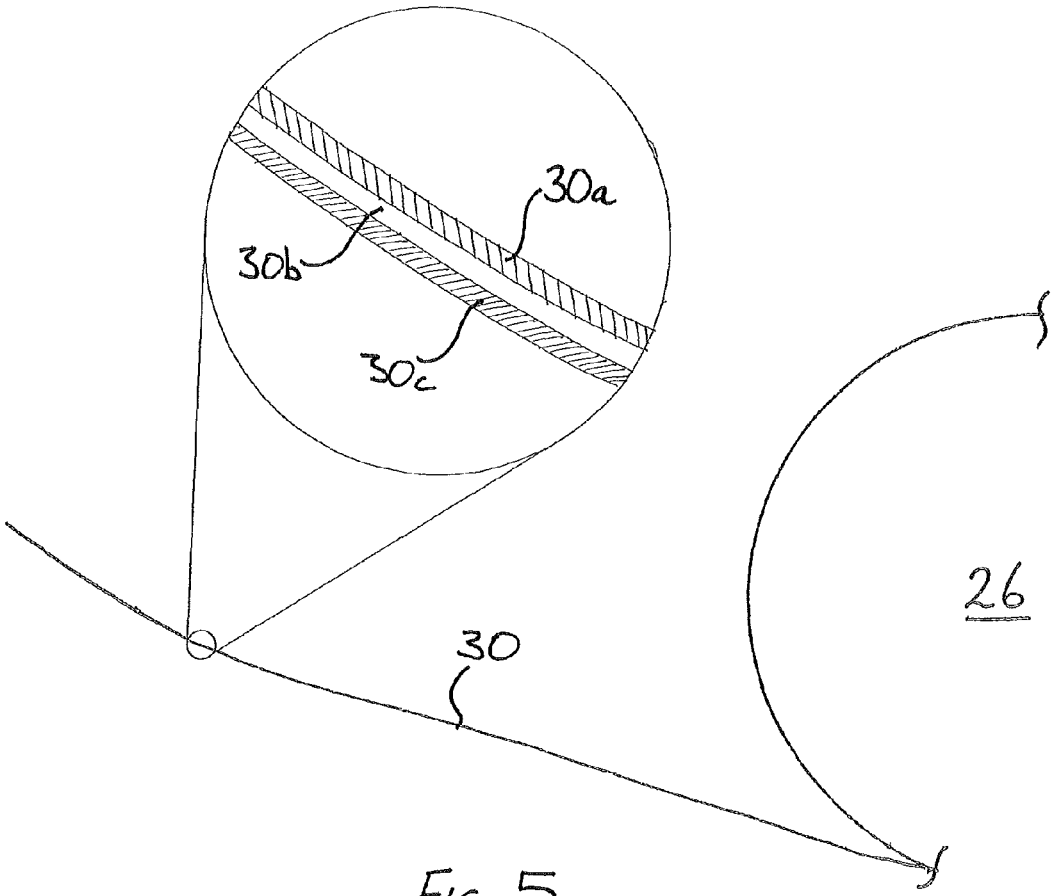
FIG. 5 is an enlarged view of a portion of the continuous strip of strengthening material.

The strengthening material 22 used in the above-described process is preferably a metallic foil provided with a heat activated adhesive on one side thereof, preferably an aluminium foil. An enlarged view of a portion of the continuous strip 30 of strengthening material is shown in FIG. 5 and it can be seen that it comprises a laminate metallised plastic film comprising a plastic backing or 'carrier' layer 30*a*, a metallic laminate layer 30*b* of the strengthening material on the carrier film 30*a* and a layer of heat and/or pressure activated adhesive 30*c* on the metallic laminate layer 30*b*. In the above described process, as the die 32 presses against the carrier film 30*a* and transmits heat and pressure to the metallised laminate strip 30 against the other roller 28, the heat melts and activates the adhesive layer 30*c* in the area of the die 32 and as the die 32 exerts pressure on the strip 30, the portion of the adhesive layer 30*c* under the die 32 bonds the corresponding area of the metallic laminate layer 30*b* to the band 24 of tipping wrapper material. That discrete section of strengthening material 22 thereby detaches from the plastic carrier film 30*a* and remains adhered to the band 24' of tipping wrapper as the band 24' of tipping wrapper and carrier film 30*a* diverge.

Figure 6:
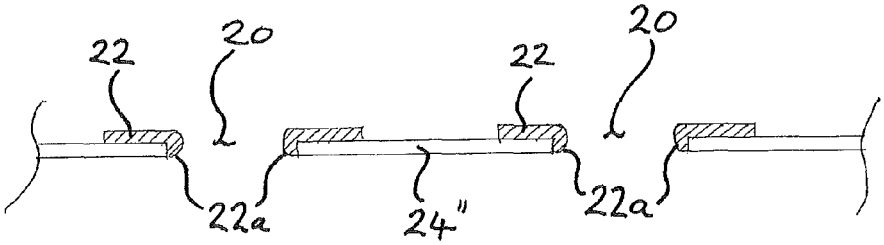
FIG. 6 is a cross-sectional view of the continuous band of wrapper material along the line X-X in FIG. 3.

The apertures 20 formed in the resulting band 24" of tipping wrapper material are strengthening by the discrete sections of strengthening material 22 which surround each aperture 20. These are shown in detail cross-section in FIG. 6. The cutter 38 cuts the aperture 20 first through the layer of strengthening material 22 and then through the tipping wrapper material. This causes the strengthening material 22 to be forced through the apertures 20 so as to curve around the inside edge of the aperture formed in the tipping wrapper. These curved edges 22*a* of the strengthening material 22 provide further strengthening around the apertures 20 of the resulting tipping wrapper 16, and also optimise the edges of the apertures 20 being clean-cut and reduce the swarf being generated by the aperture-forming process.

The process described above of applying the section of metallic laminate 30*b* to the paper substrate is known as a 'hot foil' process, as heat is used to activate the portion of the adhesive layer 30*c*, as well as pressure being used to bond the discrete section of strengthening material 22 to the band 24 of tipping wrapper material. However, an alternative process may be used within the scope of the invention where the adhesive layer comprises only a pressure-activated adhesive and so simply the pressure of the die 32 on the laminate strip 30 is sufficient to bond the discrete sections of the metallic layer to the band of tipping wrapper material without requiring heat to be applied. In such an embodiment, known as a 'cold foil' process, neither of the first pair of rollers would need to be heated.

Other variations to the above described process within the scope of the invention include the roller 28 other than the one including the die 32 may be heated and used to apply the heat to activate the adhesive of the adhesive layer 30*c*. In addition, the strengthening material 22 applied to the band of tipping wrapper material may not necessarily be metallic—for example, the strengthening material 22 may be a plastic material. Furthermore, the laminate strip of strengthening material 30 may only comprise a carrier film and a strengthening material laminate layer thereon, and the adhesive to bond the strengthening material to the band of tipping wrapper material may be applied to the strengthening material laminate layer in an intermediate step, for example, by spraying or by passing the laminate strip of strengthening material over a transfer roller to which adhesive is applied.

Figure 4:
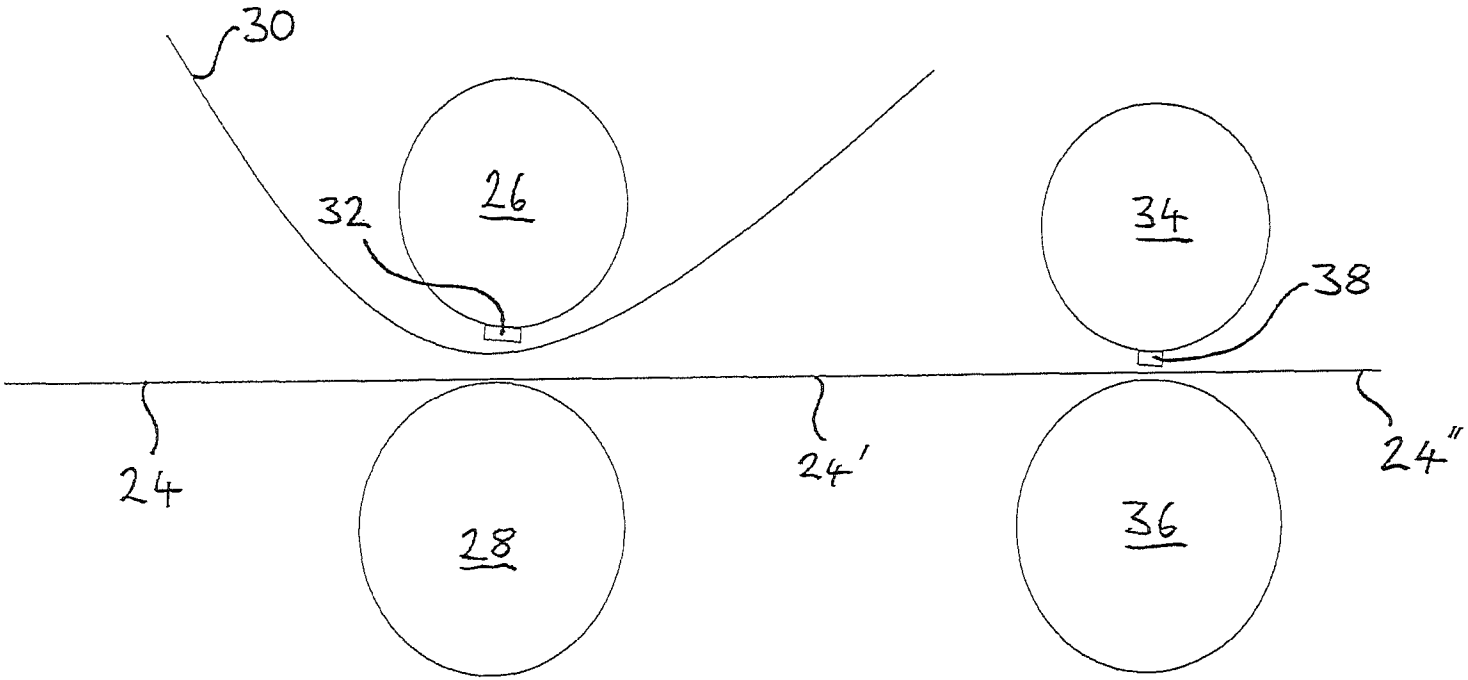
FIG. 4 is a schematic view of an apparatus for producing the wrapper material shown in FIG. 3.

Although the apparatus shown schematically in FIG. 4 and described above includes only one die 32 and one cutter 38 on the respective ones of the first and second rollers 26, 34, there may be more than one die/cutter provided on each respective roller, or for example, the roller 26 with the die 32 may include a plurality of dies around its circumference and the roller 34 with the cutter may be proportionally smaller in diameter but include fewer cutters 38, so long as the rotation of the cutter roller 34 is in register with the movement of the band 24' of tipping wrapper material with sections of strengthening material 22 adhered thereto such that an aperture 20 is cut through each discrete section of strengthening material 22.

Furthermore, although the process and manufacturing apparatus shown in FIG. 4 and described above shows the cutter 38 disposed on the roller 34 so that it is on the same side of the band 24' of tipping wrapper material as the strengthening material 22, the cutter may alternatively be on the other roller 36 of the second pair of rollers so that it is on the other side of the band 24' of tipping wrapper material to the strengthening material 22 so that it cuts first through the tipping wrapper material and then through the strengthening material. Although this embodiment would result in strengthened apertures in the band of tipping wrapper material, it would not have optimised aperture strengthening as the strengthening material would not be punched in a direction to create the curved edges 22*a* of the strengthening material 22 around the edges of the apertures in the tipping wrapper material.

Figure 7:
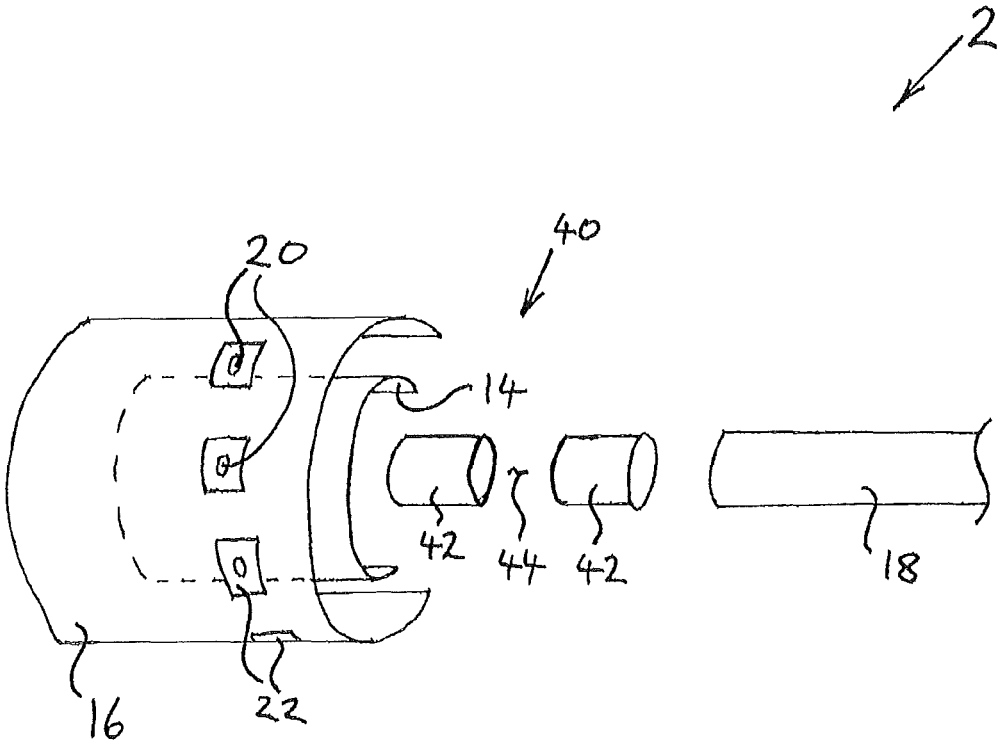
FIG. 7 is an exploded perspective view of a smoking article including a filter of an alternative embodiment of the invention.

Referring now to FIG. 7, a smoking article 2 is shown including a filter 40 of an alternative embodiment of the present invention. The features described above with reference to the filter of the first embodiment are identical to those of the second embodiment and retain the same reference numerals. However, the plug 12 of filtration media of the first embodiment is replaced by a plurality of smaller, axially-aligned plugs 42 of filtration media spaced from each other to define a cavity 44 therebetween. Within the scope of the invention, this cavity 44 may be empty (i.e. an air space), filled with an adsorbent filler material, such as activated charcoal/carbon or other known suitable material, or alternatively may include an additional plug of a secondary filtration material such as, but not limited to, cellulose acetate filter material, or a cellulose acetate with adsorbent carbon dispersed therethrough, or any selective adsorbent material.

In a smoking article 2 including a filter 40 is this alternative embodiment of the invention, the apertures 20 in the tipping wrapper 16 may preferably be aligned so that the cavity 44 is visible though the resulting windows formed by the apertures 20. The visible cavity 44 may include a material provided with a coloured or patterned surface, or a consumer-recognisable characteristic, to be visible through the window, or may include a material with colour activation properties such that a colour change in the material can be visible through the window of the filter 40.

Figure 8:
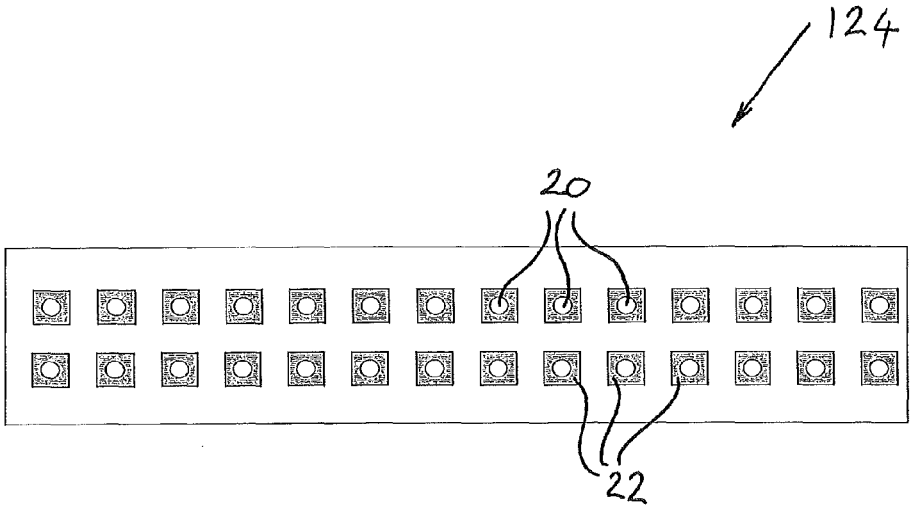
FIG. 8 is a plan view of a section of a continuous band of wrapper material of another alternative embodiment of the invention.

In the above-described embodiments, the tipping wrapper 16 includes one single line of apertures 20 around the filter 10, 40. However, the tipping wrapper 16 may alternatively comprise more than one line of apertures formed through discrete sections of strengthening material 22 bonded thereto. A continuous band 124 of tipping wrapper material to create such an alternative filter is shown in FIG. 8. Manufacture of such a tipping wrapper material can be as described above except the rollers 26, 34 which include the single die 32 and single cutter 38 would respectively include two dies and cutters axially spaced on the outer circumference of the respective roller 26, 34. Furthermore, a tipping wrapper of the invention may alternatively comprise more than two lines of apertures, with appropriate modification of die and cutter rollers. In such multiple-aperture line filters, the lines of apertures may be aligned with different discrete plugs of filtration media within the filter, or cavities, filled with filler material or as an empty air space.

Figure 9:
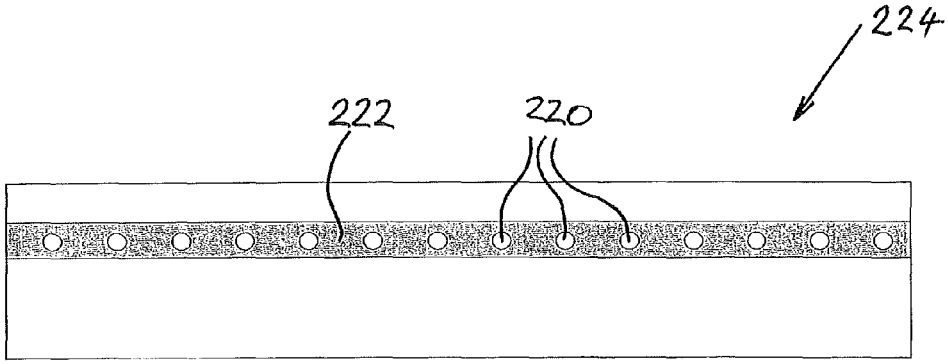
FIG. 9 is a plan view of a section of a continuous band of wrapper material of yet another alternative embodiment of the invention.

A continuous band 224 of tipping wrapper material of a further alternative embodiment of the invention is shown in FIG. 9. Here it can be seen that instead of discrete sections of strengthening material 22, the continuous band 224 of tipping wrapper material includes a single continuous strip 222 of strengthening material and a plurality of apertures 220 are formed at regular spacing along the strip 222. This alternative embodiment of the invention provides the same advantages of strengthened apertures 220, which when cut out using the process described above with reference to FIG. 4, include the curved edges of strengthening material around the apertures in the tipping wrapper material, thereby provided clean-cut edges and reduced swarf during manufacture. However, this embodiment provides the additional advantage that, since the strengthening material is in the form of a continuous strip 222 and not discrete spaced sections as in the previous described embodiments, there is no need for the position of the cutter 38 and the rotation of the second pair of rollers 34, 36 to be in register with position and the conveyance speed of the continuous band 224 of tipping wrapper material because there are no discrete spaced sections of strengthening material with which the cutter 38 needs to be aligned. Instead, the cutter 38 can simply cut the apertures in the continuous strip 222 of strengthening material at regular intervals. It will be appreciated that to create the band 224 of tipping wrapper material with a continuous strip 222 of strengthening material, the first pair of rollers 26, 28 would generally include a continuous die around its entire circumference rather than one or more discrete dies spaced around its circumference. This way, as the first pair of rollers 26, 28 rotate, the die is continuously pressing against the metallised laminate strip 30 of strengthening material and so thereby forming a continuous strip of strengthening material 222 onto the band 24 of tipping wrapper material.

Figure 10:
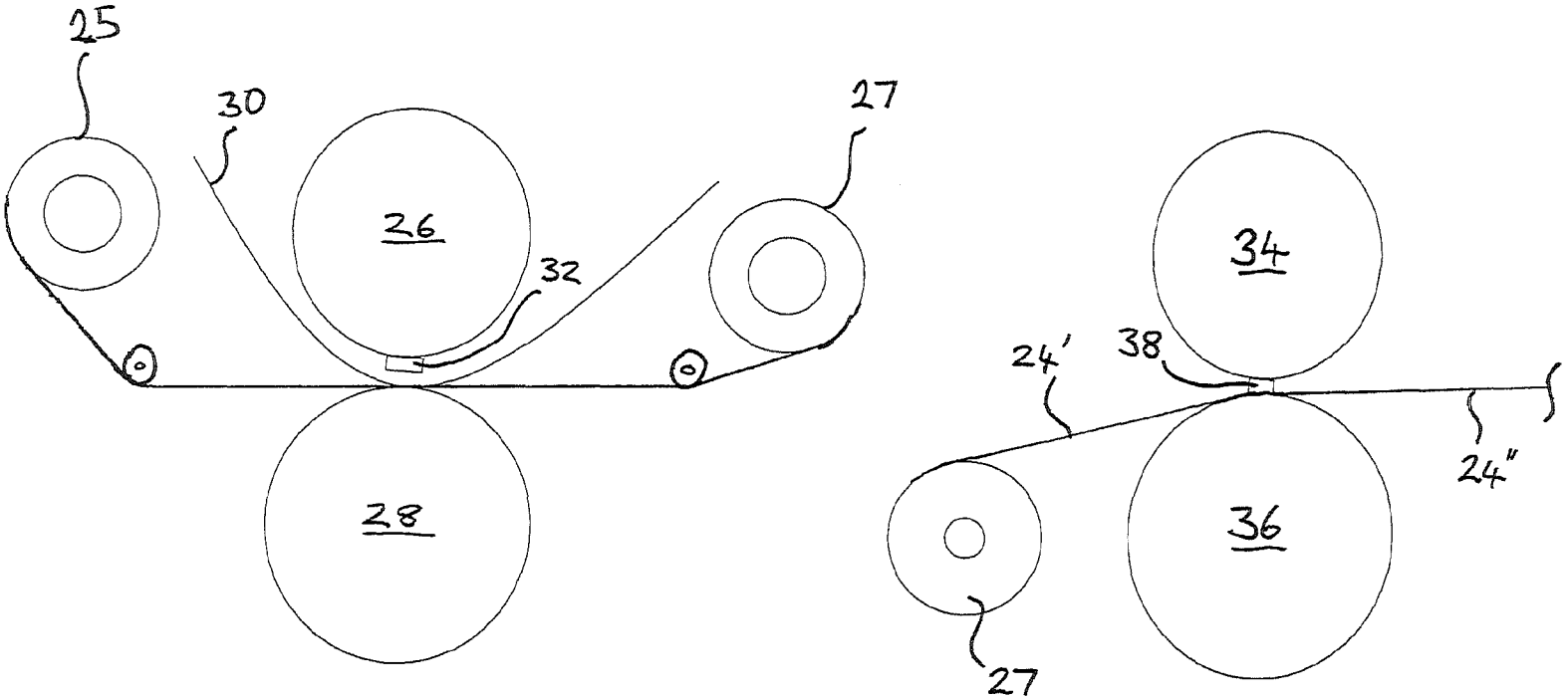
FIG. 10 is a schematic view of an alternative apparatus for producing the wrapper material shown in FIG. 3.

The manufacturing method and apparatus described above with reference to FIG. 4 involves the continuous band 24 of tipping wrapper material first having strengthening material 22 applied thereto, and then immediately after, as part of a single continuous process, having apertures 20 formed therein. It is intended within the scope of the invention that the method may alternatively comprise the two stages of the process being discrete and separate steps. This will be described with reference to FIG. 10 which schematically shows alternative manufacturing apparatuses for such a method. A continuous band 24 of tipping wrapper material is fed, for example, from a roll 25, between a first pair of rollers 26, 28. A continuous strip 30 of the strengthening material 22 is fed together with the band 24 of tipping wrapper material between the first pair of rollers 26, 28. As with the method described previously, a die 32 on one of the rollers comes into contact with the strip 30 of strengthening material 22, presses a portion of the strip 30 of strengthening material 22 into contact with the band 24 of tipping wrapper material and, in the same manner described above, sections of strengthening material 22 are then bonded to the continuous band 24 of tipping wrapper material.

This alternative method differs in that after the band 24' of tipping wrapper material with sections of strengthening material 22 is fed away from the first pair of rollers 26, 28, it is then rolled up onto a collection spool 27. Once the collection spool 27 has a predetermined length of the continuous band 24' of tipping wrapper material with sections of strengthening material 22 thereon, it is taken and loaded onto a separate apparatus for the apertures 20 to be formed through the tipping wrapper material and strengthening material 22.

In this separate process, the band 24' of tipping wrapper material with sections of strengthening material 22 is fed from the collection spool 27 and passes between a second pair of rollers 34, 36. As in the process described previously with reference to FIG. 4, a cutter 38 on an outer circumferential surface of one of the second rollers 34, 36 cuts out an aperture 20 from the band 24' of tipping wrapper at the point where each discrete section of strengthening material 22 is positioned, forming the aperture 20 though both the tipping wrapper material and the strengthening material 22, resulting in a series of strengthened apertures 20 in the resulting band 24" of tipping wrapper. This resulting band 24" of tipping wrapper can then either proceed directly to a known smoking article manufacturing apparatus, or may be wound up on a second collection spool (not shown) to be stored and used in a known smoking article manufacturing apparatus in a separate subsequent stage. The method of this alternative embodiment of the invention has the advantage that there is no need for adjusting the tensioning of the band 24' of tipping wrapper material with sections of strengthening material 22 between the first and second pairs of rollers, which simplifies the apparatus and process. It also means that the manufacturing apparatus does not necessarily need to be one large machine doing both jobs of applying the strengthening material and also cutting the apertures, and instead, can comprise two smaller machines doing one job respectively. This also means that the two machines can be in separate locations and each process can take place independently of the other.

Figure 11:
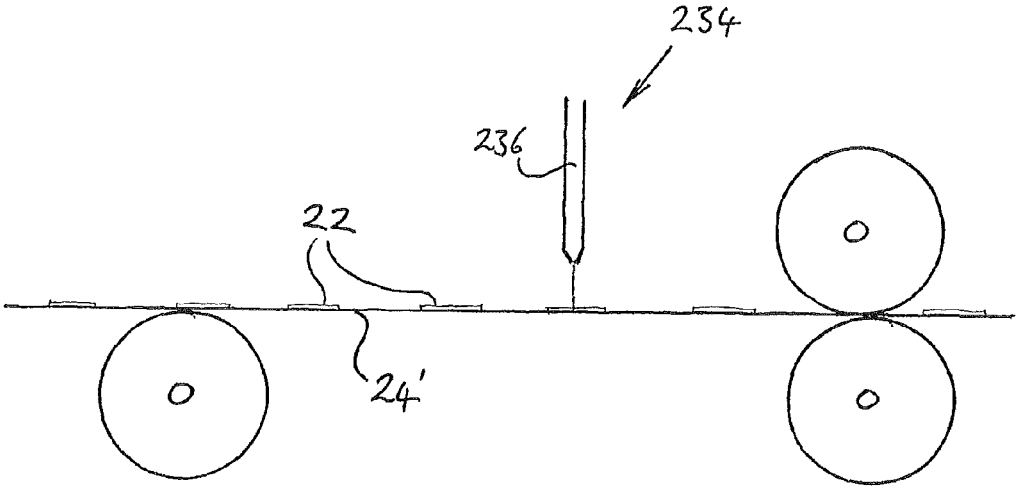
FIG. 11 is a schematic view of an alternative apparatus for producing apertures in the wrapper material shown in FIG. 3.
Figure 12A:
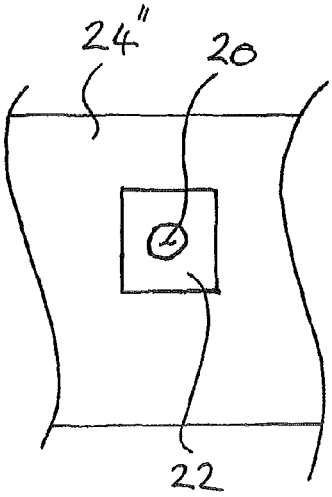
FIGS. 12*a* and 12*b* are enlarged schematic views of apertures in portions of wrapper material formed using the apparatus of FIG. 11.
Figure 12B:
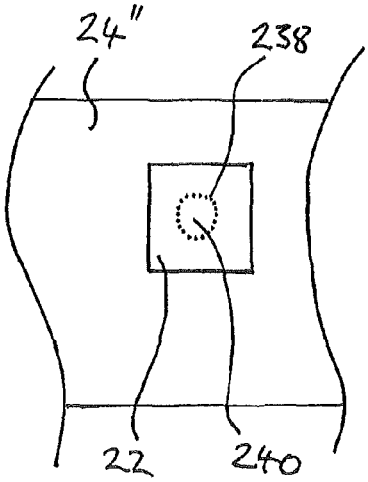

In the above-described manufacturing processes and apparatuses of the invention, the apertures 20 in the tipping wrapper 16 are formed by a cutter on a roller. However, it is intended within the scope of the invention that other means may be used to form the apertures 20 in the tipping wrapper 16. For example, the second pair of rollers 34, 36 with the cutter 38 may be replaced by a laser cutter. Such an alternative embodiment is shown schematically in FIG. 11, which shows the band 24' of tipping wrapper material with sections of strengthening material 22, which has passed from the first pair of rollers 26, 28, to a cutting station 234 which comprises a laser cutter 236. The laser cutter 236 is positioned and configured to then burn the apertures 20 into the band 24' of tipping wrapper material. This may be done by the laser beam width being sized so as to burn a single aperture through the band 24' of tipping wrapper material, as shown in FIG. 12*a*, or alternatively, the laser beam may rapidly cut a series of pin-point apertures 238 around the circumference of the intended aperture, as shown in FIG. 12*b*, and the material 240 in the middle of the intended aperture may subsequently be removed, for example by falling under gravity or by being forced out by an air jet.

Although the plugwrap 14 is described as being transparent, it may also be at least partially transparent, for instance translucent with a coloured tint or pattern to provide a different aesthetic effect to the filter 10, 40 whilst still allowing the plug(s) of filtration media 12 or cavity 44 inside of the filter 10, 40 to be visible through the aperture(s) 20 and through the plugwrap 14. Alternatively, the invention is applicable to filter constructions which do not include fully transparent or at least partially transparent plug wraps. For instance, the invention is applicable to constructions not including plug wraps, in which the at least one window in the tipping paper allows the filter material itself or other filter components to be visible, or which have opaque plug wraps made visible through the at least one tipping window.

In further alternative embodiments envisaged within the scope of the invention, the filter of the invention may comprise more than two plugs of filtration media, either spaced from each other to create more than one space within the filter or abutting each other as a continuous sequence of plugs of filtration media, and apertures within the tipping wrapper material may be aligned such that one or more of the spaces within the filter are visible though the resulted windows.

The various embodiments of filter 10, 40 described and shown, and claimed within the scope of the present invention, can be manufactured in appropriate dimensions to be suitable for use in conjunction with various size formats of smoking articles, such as those commonly referred to as 'slim', 'super-slim', 'kingsize', as well as regular smoking articles.

Although the manufacturing processes described above and illustrated schematically in FIGS. 4 and 10 comprise a first set of rollers 26, 28 with a die 32 to adhere discrete sections of strengthening material 22 to the continuous band 24 of tipping wrapper material, and then a second set of rollers 34, 36 with a cutter 38 to cut out the apertures 20 from the band 24' of tipping wrapper material with strengthening material adhered thereto, the invention is not intended to be limited to such an embodiment. For example, it is envisaged within the scope of the invention that a single pair of rollers may be provided with a combined die and cutter on the outer circumferential surface of one of the rollers. This would enable the roller to simultaneously punch out and adhere a section of strengthening material 22 from a continuous strip 30 to the band 24 of tipping wrapper material and cut out an aperture 20 though the strengthening material 22 and through the tipping wrapper material. In such an embodiment, the aperture-cutter portion could be formed within the die portion and may possibly be spring-biased into a recess in the die so that it is pushed out of the die to cut out an aperture once the die punches out and adheres the strengthening material 22 onto the band 24 of tipping wrapper material, as the rollers of the single set of rollers rotate so the die/cutter is biased against the other of the rollers.

The die 32 provided on one of the first roller 26, 28 may be a separate element secured to the respective roller, or the roller in question may be a debossed roller where the outer surface of the roller is not even and a die portion is provided as a raised boss above the remaining outer surface of the roller.

In the embodiments of the filters 10, 40 described above, the discrete sections of strengthening material 22 are shown and described as square, and the apertures 20 are shown and described as circular. However, the invention is not limited to these specific configurations and either may be of another shape, such as round, oval, triangular, square, rectangular, star-shaped, or many other alternative configurations.

Although in the embodiments shown in the Figures and described above, the filter includes the sections of strengthening material on the outside of the filter, the invention is not intended to be limited to this arrangement, and the strengthening material may be on the inside of the filter—i.e. lying adjacent and in contact with the plugwrap. However, it will be appreciated that if the strengthening material is on the outside of the filter, it can create an additional and distinctive aesthetic appearance to the filter, possibly helping product differentiation for a consumer.

The methods of the invention and the apparatuses used, described above and shown in FIGS. 4 and 10, comprise rollers 26, 28 being used to apply the strengthening material to the tipping wrapper material, and further rollers 34, 36 being used to form the apertures in the tipping wrapper material. However, it is intended within the scope of the invention that alternative apparatuses may be used to perform these operations other that rollers. For example, the strengthening material and/or the apertures may be formed on the tipping wrapper material on a flat bed by a press as the continuous band of tipping wrapper material is conveyed over the flat bed.

Throughout the specification, reference to 'smoking material' can mean any material which can be used in the smoking article such as tobacco material or tobacco substitute.

Although various embodiments of the invention have been shown and described, it will be appreciated that these are exemplary embodiments only and the invention is also intended to include any combination of non-mutually exclusive features described above, and that modifications may be made to these exemplary embodiments within the scope of the invention as defined in the claims hereafter.

The invention claimed is:

1. A wrapper for a smoking article filter, the wrapper comprising: at least one aperture; and an additional strengthening material around the at least one aperture, wherein the strengthening material is a solid material bonded to the wrapper and extending into the at least one aperture around the edges of the at least one aperture to define a window in the wrapper; wherein the window is an open window through the wrapper and through the strengthening material.

2. The wrapper according to claim 1, wherein the strengthening material comprises metal foil.

3. A filter for a smoking article comprising: a cylindrical plug of filtration media a plugwrap of at least partially transparent material wrapped around the plug of filtration media; and an outer wrapper circumscribing the plug and plugwrap, the outer wrapper comprising: at least one aperture; and an additional strengthening material around the at least one aperture, wherein the strengthening material is a solid material bonded to the wrapper and extending into the at least one aperture around the edges of the at least one aperture to define a window in the wrapper, wherein the plug and plugwrap are visible through the window defined by the at least one aperture; wherein the window is an open window through the wrapper and through the strengthening material.

4. The filter according to claim 3, further comprising a plurality of axially aligned cylindrical plugs of filtration media wherein at least two of the plugs are axially spaced from each other to define one of an empty cavity and a region filled with an adsorbent material between the plugs of filtration media.

5. The filter according to claim 3, wherein a portion of at least one of the filtration media and the plugwrap comprises at least one of indicia and graphics on an outer surface thereof, so as to be visible through said at least one window.

6. A smoking article comprising: a filter comprising: a cylindrical plug of filtration media; a plugwrap of at least partially transparent material wrapped around the plug of filtration media; and a wrapper circumscribing the plug and plugwrap, comprising: at least one aperture; and an additional strengthening material around the at least one aperture, wherein the strengthening material is a solid material bonded to the wrapper and extending into the at least one aperture around the edges of the at least one aperture to define a window in the wrapper; wherein the plug and plugwrap are visible through the window defined by the at least one aperture; wherein the window is an open window through the wrapper and through the strengthening material; and wherein the wrapper includes a tipping wrapper extending in an axial direction beyond the distal end of the at least one plug of filtration media remote from a mouth end portion attaching the filter to a rod of smokable material.

7. A method of manufacturing a wrapper for a filter for a smoking article, comprising bonding a solid strengthening material to a band of wrapper material and forming at least one aperture through the strengthening material and through the wrapper material such that the strengthening material extends into the at least one aperture and is formed around the edges of the at least one aperture to define a window in the wrapper; wherein the window is an open window through the wrapper and through the strengthening material.

8. The method according to claim 7, wherein the strengthening material is applied to the band of wrapper material by passing a laminate strip, comprising a carrier layer and a layer of the strengthening material, together with the band of wrapper material, between a pair of rollers which press the strengthening material onto the band of wrapper material.

9. The method according to claim 8, wherein at least one of the rollers includes a die on an outer surface thereof, and passing the laminate strip together with the band of wrapper material between a pair of rollers comprises the at least one die pressing a portion of the layer of strengthening material into contact with the band of wrapper material.

10. The method according to claim 9, wherein the at least one die pressing a portion of the laminate strip and the layer of strengthening material into contact with the band of wrapper material comprises the portion of strengthening material detaching from the carrier layer and adhering to the band of wrapper material.

11. The method according to claim 8, wherein at least one of the rollers is heated so that the at least one heated roller applies heat to the laminate strip and the band of wrapper material as they pass between the rollers to activate a layer of adhesive formed on the layer of strengthening material.

12. The method according to claim 8, further comprising passing the band of wrapper material between a second set of rollers, at least one roller of the second set of rollers including a cutter formed on an outer surface thereof, and the at least one aperture in the wrapper material being formed by the cutter as the band of wrapper material passes through the second set of rollers.

13. The method according to claim 8, wherein applying further comprises cutting the at least one aperture as the band of wrapper material passes through the first set of rollers.

14. The method according to claim 9, wherein the die on the outer surface of said at least one of the rollers includes a cutter element, and wherein the step of passing the laminate strip together with the band of wrapper material between a pair of rollers further comprises the at least one die pressing a portion of the layer of strengthening material into contact with the band of wrapper material so that a portion of strengthening material detaches from the laminate strip and adheres to the band of wrapper material, the cutter element of the die cutting the at least one aperture as the band of wrapper material passes through the first set of rollers.

15. The method according to claim 14, wherein the cutter element is spring-biased within the die, and is pushed out from within the die to cut the at least one aperture as the die presses against the other roller of the first pair of rollers.

16. The method according to claim 7, wherein the strengthening material comprises metal foil.

17. A method of manufacturing a filter for a smoking article, comprising bonding a solid strengthening material to a band of wrapper material and forming at least one aperture through the strengthening material and through the wrapper material such that the strengthening material extends into the at least one aperture and is formed around the edges of the at least one aperture to define a window in the wrapper; wherein the window is an open window through the wrapper and through the strengthening material; and circumscribing at least one cylindrical plug of filtration material with the wrapper so that the plug(s) of filtration material are visible through the window.

* * * * *